United States Patent [19]

Pchelin et al.

[11] Patent Number: 5,041,755

[45] Date of Patent: Aug. 20, 1991

[54] GAS-DISCHARGE LAMP

[76] Inventors: Vladimir M. Pchelin, Snaiperskaya ulitsa, 12, korpus 11, kv. 105, Moscow; Jury A. Arkhipov, ulitsa Poleznaya, 120, kv. 412, Saransk; Gennady R. Shakhparuniants, ulitsa B.Pereyaslavskaya, 11, kv. 81, Moscow, all of U.S.S.R.

[21] Appl. No.: 447,176

[22] Filed: Dec. 7, 1989

[51] Int. Cl.[5] ..... H01J 5/16; H01J 1/62

[52] U.S. Cl. ..... 313/25; 313/113; 313/634

[58] Field of Search ..... 313/25, 113, 634; 220/2.1 R

[56] References Cited

U.S. PATENT DOCUMENTS

| | | | |
|---|---|---|---|
| 4,174,487 | 11/1979 | Peeters | 313/113 |
| 4,506,185 | 3/1985 | Giller et al. | 313/634 |
| 4,567,396 | 1/1986 | McVey | 313/25 |

FOREIGN PATENT DOCUMENTS

| | | | |
|---|---|---|---|
| 226429 | 8/1985 | German Democratic Rep. | 313/113 |
| 59-12554 | 1/1984 | Japan . | |
| 517273 | 7/1977 | U.S.S.R. | 313/113 |

*Primary Examiner*—Donald J. Yusko
*Assistant Examiner*—Diab Hamadi
*Attorney, Agent, or Firm*—Burgess, Ryan & Wayne

[57] ABSTRACT

A gas-discharge lamp has an envelope which accommodates a longitudinally extending high-pressure inner tube which is secured to current leads sealed in a stem of the envelope. At least one-half of the entire inner surface of the envelope has a reflector coating applied in such a manner that a plane drawn through extremities of the reflector coating runs in parallel with a longitudinal axis of the high-pressure inner tube. The envelope is of a cross-sectional configuration in which the distance from the axis of the inner tube to the surface of the reflector coating varies continuously. The ratio of the shortest distance ($r_{min}$) from the axis of the inner tube to the surface of the reflector coating to the respective maximum distance ranges from 0.6 to 1.0.

4 Claims, 1 Drawing Sheet

GAS-DISCHARGE LAMP

FIELD OF THE INVENTION

The invention relates to discharge lighting fixtures, and more specifically it deals with gas-discharge lamps.

The invention may be used for illumination of roads, streets and industrial projects.

BACKGROUND OF THE INVENTION

Widely known in the art is a gas-discharge high-pressure mercury vapour lamp (JP, A, No. 59-12554), comprising an envelope which accommodates a longitudinally extending inner tube. The envelope is round-symmetrical. One-half of the inner surface of the envelope has a mirror reflector coating applied in such a manner that a plane drawn through extremities of the reflector coating runs in parallel with the longitudinal axis of the inner tube. One part of light radiation of the inner tube passes through a transparent area of the envelope without being reflected from the reflector coating. The other part of the light radiation of the inner tube is incident upon the mirror reflector coating and is reflected therefrom. A part of the light radiation reflected from the mirror reflector coating goes back to the inner tube and is absorbed therein thus lowering luminous eficacy of the gas-discharge lamp.

Also widely known in the art is a high-pressure sodium gas-discharge lamp (DD, A, No. 226429), comprising a cylindrical envelope which accommodates a longitudinally extending high-pressure inner tube. The inner tube is secured to current leads which are sealed in the envolope stem. About one-half of the inner surface of the envelope has a mirror reflector coating applied in such a manner that a plane drawn through extremities of the reflector coating runs in parallel with the longitudinal axis of the inner tube. The inner tube is positioned in the envelope in such a manner that its axis runs in parallel with, hand is offset from, the longitudinal axis of the envelope in the direction towards the surface of the envelope having the reflector coating at a distance which is shorter than one-half of the radius of the cross-section of the envelope. One part of light radiation of the inner tube passes through the transparent area of the envelope without being reflected from the mirror reflector coating. The other part of the light radiation is reflected from the mirror reflector coating and partly goes back to the inner tube to be absorbed therein. The offset position of the inner tube with respect to the axis of the envelope makes it possible to lower the part of light radiation absorbed in the inner tube, but absorption of light radiation reflected from the mirror reflector coating cannot be completely avoided. As a result, luminous eficacy of the gas-discharge lamp is rather low.

Depending on position of the inner tube with respect to the cylindrical surface having a mirror reflector coating, gas-discharge lamps may have different non-round-symmetrical pattern of distribution of light radiation, but the range of possible patterns of distribution of light radiation is extremely limited.

SUMMARY OF THE INVENTION

It is an object of the present invention to provide a gas-discharge lamp with a desired pattern of distribution of light.

It is another object of the present invention to provide a gas-discharge lamp having an improved luminous eficacy.

These objects are achieved by that in a gas-discharge lamp comprising an envelope which accommodates a longitudinally extending high-pressure inner tube secured to current leads sealed in a stem of the envelope, at least one-half of the inner surface of the envelope having a reflector coating applied in such a manner that a plane drawn through extremities of the reflector coating runs in parallel with the longitudinal axis of the high-pressure inner tube, according to the invention, the envelope is of a cross-sectional configuration in which the distance from the axis of the inner tube to the surface of the reflector coating varies continuously, and the ratio of the shortest distance from the axis of the inner tube to the surface of the reflector coating to the respective maximum distance ranges from 0.6 to 1.0.

To facilitate manufacture of the envelope of the gas-discharge lamp, it is preferred that the distance in the cross-section of the envelope from the axis of the inner tube to the surface of reflector coating vary continuously in a single manner only.

It is preferred that, in order to ensure various patterns of distribution of light radiation of a gas-discharge lamp, the distance in the cross-section of the envelope from the axis of the inner tube to the surface of the reflector coating alternately increasesand decreases.

The invention makes it possible to provide gas-discharge lamps with various patterns of distribution of light radiation within a wide range and also allows luminous eficacy of a gas-discharge lamp to be improved by avoiding absorption of the reflected light radiation in the inner tube.

BRIEF DESCRIPTION OF THE DRAWINGS

The invention will now be described with reference to specific embodiments of a high-pressure gas-discharge lamp illustrated in the accompanying drawings, in which.

DETAILED DESCRIPTION OF THE INVENTION

Figure 1:
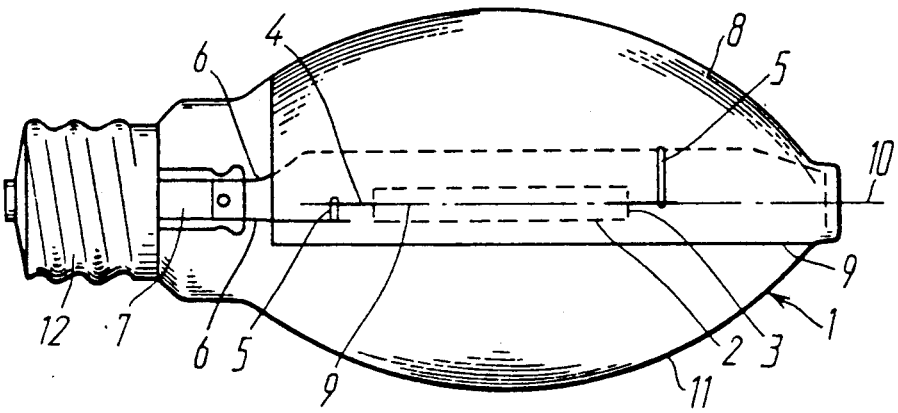
FIG. 1 shows a gas-discharge lamp in a general side elevation view, according to the invention.

A gas-discharge lamp comprises an envelope 1 (FIG. 1) which accommodates a longitudinally extending high-pressure inner tube 2. Secured to ends 3 of the inner tube 2 are current leads 4. The current leads 4 are connected by means of nickel tabs 5 to current leads 6 which are sealed in a stem 7 of the envelope 1.

The high-pressure inner tube 2 is made of aluminium dioxide and is filled with an inert gas, mercury or sodium.

The envelope 1 may be evacuated or filled with an inert gas.

Figure 2:
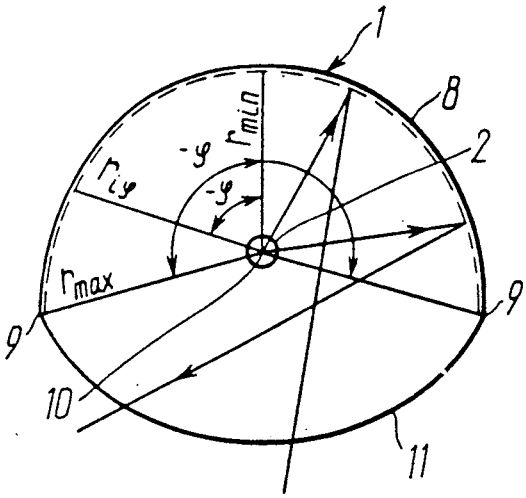
FIG. 2 shows a cross-sectional view of an envelope of a gas-discharge lamp according to the invention.

At least one-half of the entire inner surface of the envelope 1 has a mirror reflector coating 8 applied in such a manner that a plane drawn through extremities 9 of the reflector coating runs in parallel with a longitudinal axis 10 of the inner tube 2. The inner tube 2 (FIG. 2) is positioned in the interior space of the envelope between the plane drawn through the extremities 9 of the reflector coating 8 and the surface of the reflector coating 8.

Angle $\phi$ of cover of the inner tube 2 with the reflector coating 8 in the cross-section is from 180° to 240°.

The envelope is of a cross-sectional configuration in which the distance r from the axis 10 of the inner tube 2 to the surface of the reflector coating 8 of the envelope 2 varies continuously. The ratio of the shortest distance $r_{min}$ from the axis 10 of the inner tube 2 to the surface of the reflector coating 8 to the respective maximum distance $r_{max}$ ranges from 0.6 to 1.0.

In another embodiment of the envelope 1, the distance r in the cross-section of the envelope 1 from the axis 10 of the inner tube 2 of the surface of the reflector coating 8 varies continuously in a single manner only, e.g. continuously increases.

Figure 3:
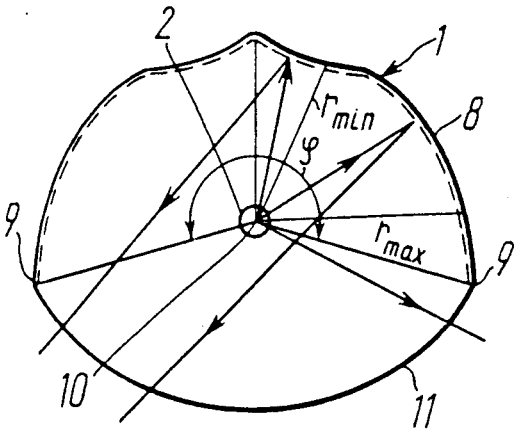
FIG. 3 shows another embodiment of an envelope of a gas-discharge lamp in a cross-sectional view, according to the invention.

To achieve a desired pattern of distribution of light radiation, a part of the envelope 1 (FIG. 3) having its inner surface provided with the reflector coating 8 is made in such a manner that the distance r in the cross-section of the envelope 1 from the axis 10 of the inner tube 2 to the surface of the reflector coating 8 alternately increases and decreases.

A transparent area 11 (FIG. 1) of the envelope 1 is convex. The configuration of the transparent area 1 is chosen in accordance with manufacturing considerations.

The gas-discharge lamp also has a base 12 for connecting the lamp to a power supply.

The gas-discharge lamp functions in the following manner.

When voltage is supplied to the current leads 4 (FIG. 1), gas discharge is initiated in the inner tube 2. Light radiation of the inner tube 2 is directed at the reflector coating 8 and transparent area 11 of the envelope 1. One part of the light radiation of the inner tube 2 (FIG. 3) passes through the transparent area 11 of the envelope 1 without being reflected from the mirror reflector coating 8. The other part of the light radiation of the inner tube 2 is incident upon the mirror reflector coating 8 and is reflected therefrom. As the distance r from the axis of the inner tube 2 to the surface of the reflector coating 8 varies continuously in the cross-section of the envelope 1, a perpendicular drawn to the surface of the reflector coating 8 a the point of incidence of the beam is not directed at the axis 10 of the inner tube 2 but rather passes by. As a result, the light radiation, which is not attenuated in the inner tube 2, passes through the transparent area 11 of the envelope 1.

Therefore, the gas-discharge lamp features a higher luminous eficacy.

Gas-discharge lamps with various configurations of the reflector coating can produce various patterns of distribution of light radiation depending on the character of variation of the distance in the cross-section of the envelope from the axis of the inner tube 2 to the surface of the reflector coating 8.

If the ratio $r_{i\,min}/r_{i\,max}$ of the shortest distance $r_{i\,min}$ from the the axis 10 of the inner tube 2 to the surface of the reflector coating 8 to the respective maximum distance $r_{i\,max}$ is below 0.6, the cross-sectional configuration of the envelope 1 will be substantially different from a round-symmetrical cross-sectional configuration so as to result in substantial difficulties in the manufacture of the envelope thus impairing reproducibility of geometrical parameters of the inner surface of the envelope 1, hence, reproducibility of the pattern of distribution of light radiation.

The range of variation of maximumg angle of cover $\phi$ of the inner tube 2 with the surface of the reflector coating 8 in the cross-section is determined in accordance with the following considerations. With $\phi < 180°$, a part of light radiation occurs beyond the limits of the half-space of the envelope 1 thus resulting in lowering of useful part of light radiation. An increase of $\phi < 180°$ enlarges the possibilities of providing gas-discharge lamps with various patterns of distribution of light radiation, but with $\phi < 220°$ the fraction of light radiation repeatedly reflected in the envelope 1 substantially increases so as to lower luminous eficacy of the gas-discharge lamp.

The use of the gas-discharge lamps according to the invention for illumination of roads and streets makes it possible to lower electric energy consumption by 1.3–1.5 times and reduce the mass of lighting fixtures by 20–30%.

We claim:

1. A gas-discharge lamp comprising an envelope having a stem, a high-pressure inner tube having a longitudinal axis running along said tube, current leads which are seales in said stem of said envelope on which is fixed said high-pressure inner tube, at least one-half of the entire inner surface of said envelope having a reflector coating applied in such a manner that a plane drawn through extremities of said reflector coating runs in parallel with said longitudinal axis of said high-pressure inner tube, wherein the envelope is of a cross-sectional configuration in which the distance from the axis of the inner tube to the surface of the reflector coating varies continuously and the ratio of the shortest distance $r_{min}$ from the axis of the inner tube to the surface of the reflector coating to the respective maximum distance ranges from 0.6 to 1.0.

2. A gas-discharge lamp according to claim 1 wherein the distance from the axis of the inner tube to the surface of the reflector coating varies continuously at the same rate.

3. A gas-discharge lamp according to claim 1, wherein the distance from the axis of the inner tube to the surface of the reflector coating alternately increases and decreases.

4.The gas-discharge lamp according to claim 2 wherein the distance from the axis of the inner tube to the surface of the reflector coating continuously increases at the same rate.

* * * * *